US008784040B2

(12) United States Patent
Masuda et al.

(10) Patent No.: US 8,784,040 B2
(45) Date of Patent: Jul. 22, 2014

(54) VENTILATOR

(75) Inventors: Kenji Masuda, Tokyo (JP); Yoshikatsu Nankaku, Tokyo (JP); Daisuke Nagasaki, Tokyo (JP); Akihiro Ikawa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 928 days.

(21) Appl. No.: 12/919,335

(22) PCT Filed: May 26, 2008

(86) PCT No.: PCT/JP2008/059675

§ 371 (c)(1),
(2), (4) Date: Aug. 25, 2010

(87) PCT Pub. No.: WO2009/144778

PCT Pub. Date: Dec. 3, 2009

(65) Prior Publication Data

US 2011/0008159 A1 Jan. 13, 2011

(51) Int. Cl.

| | |
|---|---|
| ***F01D 15/00*** | (2006.01) |
| ***F04D 29/60*** | (2006.01) |
| ***F24F 7/013*** | (2006.01) |
| ***F04D 25/12*** | (2006.01) |
| ***F04D 29/42*** | (2006.01) |

(52) U.S. Cl.

CPC ..... *F24F 7/013* (2013.01); *F04D 29/601* (2013.01); *F04D 25/12* (2013.01); *F04D 29/4226* (2013.01)

USPC ..... 415/121.3; 415/214.1; 415/232

(58) Field of Classification Search

USPC ..... 415/203, 206, 213.1, 214.1, 232, 121.3; 220/831, 832, 259.1, 259.2; 292/1, 292/338, 339, 262, DIG. 15, DIG. 38

See application file for complete search history.

(56) References Cited

U.S. PATENT DOCUMENTS 286,891 A * 10/1883 Abbot ..... 108/38
2,780,981 A * 2/1957 Miller ..... 454/346

(Continued)

FOREIGN PATENT DOCUMENTS

JP 1-123141 U 8/1989
JP 2-16939 U 2/1990

(Continued)

OTHER PUBLICATIONS

JP56-101524.*

(Continued)

*Primary Examiner* — Edward Landrum
*Assistant Examiner* — Ryan Ellis
(74) *Attorney, Agent, or Firm* — Buchanan Ingersoll & Rooney PC

(57) ABSTRACT

A ventilator includes a body casing having an opening formed in its lower portion and an exhaust port formed on one side; a fan that is provided in the body casing, for sucking indoor air from the opening and exhausting the indoor air from the exhaust port; a resin fan casing that has a suction port and forms an air passage of the fan; a protection frame formed outside the air passage to cover a terminal block provided outside the air passage; a resin terminal block cover that watertightly seals a protection frame opening of a lower portion of the protection frame and is opened and closed; a sheet-metal case that is provided in the protection frame and stores the terminal block; and a sheet-metal terminal block cover that opens and closes a lower opening of the sheet-metal case.

3 Claims, 6 Drawing Sheets

(56) References Cited

U.S. PATENT DOCUMENTS

| | | | | |
|---|---|---|---|---|
| 5,473,841 | A * | 12/1995 | Grillo | 49/394 |
| 7,455,500 | B2 * | 11/2008 | Penlesky et al. | 415/206 |

FOREIGN PATENT DOCUMENTS

| | | | |
|---|---|---|---|
| JP | 8-219521 | A | 8/1996 |
| JP | 9-137986 | A | 5/1997 |
| JP | 2005-282895 | A | 10/2005 |
| JP | 2006-078129 | A | 3/2006 |

OTHER PUBLICATIONS

Translation of JP2006-78129.*
Translation of JP8-219521.*
Translation of JP9-219521.*
International Search Report (PCT/ISA/210) issued on Jul. 22, 2008, by Japanese Patent Office as the International Searching Authority for International Application No. PCT/JP2008/059675.
Written Opinion (PCT/ISA/237) issued on Jul. 22, 2008, by Japanese Patent Office as the International Searching Authority for International Application No. PCT/JP2008/059675.

* cited by examiner

VENTILATOR

TECHNICAL FIELD

The present invention relates to a ventilator that is disposed on the rear side of a ceiling of a building, sucks indoor air, and exhausts the indoor air to the outside through a duct.

BACKGROUND ART

Conventionally, there has been known a ventilator in which, the inside of a body casing being open at a bottom surface and having an exhaust port formed on one side is provided with a fan forming airflow toward the exhaust port from an opening of the bottom surface, a resin fan casing of the fan closes the opening of a lower portion of the body casing other than a suction port, a terminal block for connecting input external power supply electric wire to the fan is provided in an internal corner of the body casing and outside an air passage of the fan casing, a protection frame is formed in the fan casing in such a manner that its outer circumferential portion covering the terminal block adheres closely to an inner surface of the body casing and its upper portion is open, and a terminal block cover that watertightly seals a lower portion of the protection frame and can be opened and closed (for example, refer to Patent Document 1).

PRIOR ART DOCUMENTS

Patent Documents

Patent document 1: Japanese Patent Application Laid-Open No. 2005-282895

DISCLOSURE OF INVENTION

Problem to be Solved by the Invention

However, according to the above-mentioned related art, there has been such a problem that if the terminal block is overheated due to short-circuiting of the electric circuit or the like, the resin fan casing and the protection frame are worn.

The present invention has been made in view of the above problems and it is an object of the present invention to obtain a ventilator that can prevent a resin fan casing and a protection frame from being worn, even in a case in which a terminal block is overheated.

Means for Solving Problem

In order to attain the above object, a ventilator according to the present invention is configured in such a manner that it comprises: a body casing that has an opening formed in a lower portion and an exhaust port formed on one side; a fan that is provided in the body casing, sucks indoor air from the opening, and exhausts the indoor air from the exhaust port; a resin fan casing that has a suction port, is provided in the opening, closes the opening other than the suction port, and forms an air passage of the fan; a protection frame that is formed outside the air passage of the fan casing to cover a terminal block provided in an internal corner of the body casing outside the air passage of the fan casing; a resin terminal block cover that watertightly seals a protection frame opening of a lower portion of the protection frame and is opened and closed; a sheet-metal case that is provided in the protection frame and stores the terminal block; and a sheet-metal terminal block cover that opens and closes a lower opening of the sheet-metal case.

Effect of the Invention

The ventilator according to the present invention is advantageous such that it can prevent the resin fan casing and the protection frame from being worn, even in a case in which the terminal block is overheated.

EXPLANATIONS OF LETTERS OR NUMERALS

Figure 1:
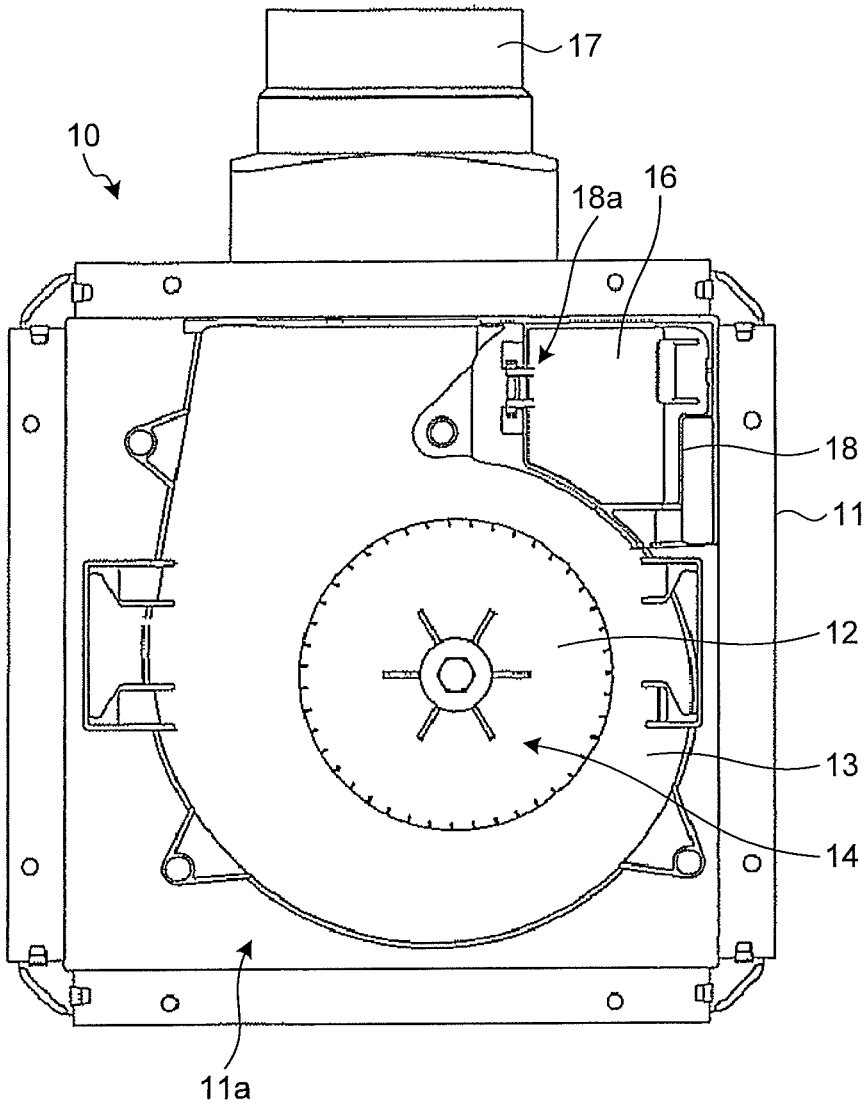
FIG. 1 is a bottom view illustrating a state in which a resin terminal block cover of a ventilator according to an embodiment of the present invention is closed.

10 Ventilator
11 Body casing
11*a* Opening
12 Fan
13 Resin fan casing
13*a* Protection frame opening
14 Suction port
15 Sheet-metal terminal block cover
15*a* Slit
15*b* Hooking portion
16 Resin terminal block cover
16*a* Rib
16*b* Claw
17 Duct connection tube
18 Protection frame
18*a* Hinge
19 Locking projection
21 Sheet-metal case
22 Cover hooking portion
25 Screw
31 Ceiling
32 Duct

33 Decorative panel
34 External power supply electric wire

BEST MODE(S) FOR CARRYING OUT THE INVENTION

Hereinafter, an embodiment of a ventilator according to the present invention will be described in detail with reference to the drawings. However, the invention is not limited by the embodiment.

Embodiment

Figure 2:
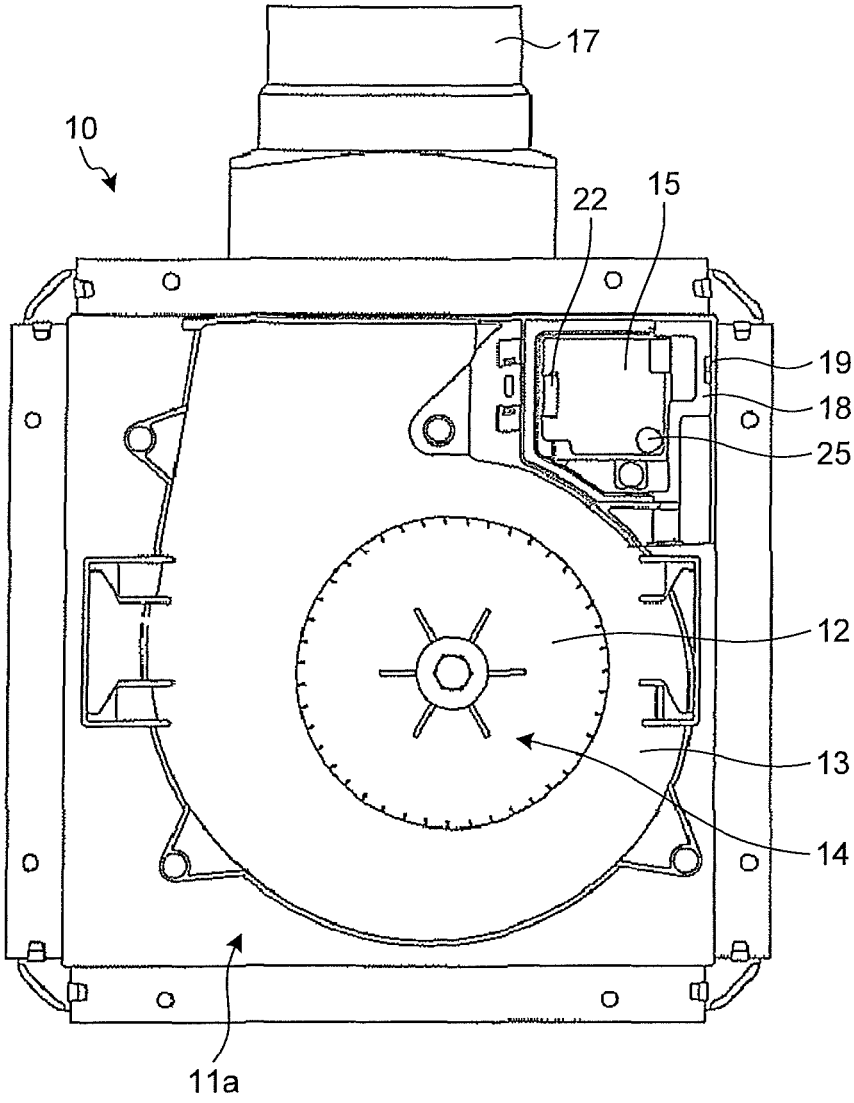
FIG. 2 is a bottom view illustrating a state in which the resin terminal block cover of the ventilator according to the embodiment is removed.
Figure 3:
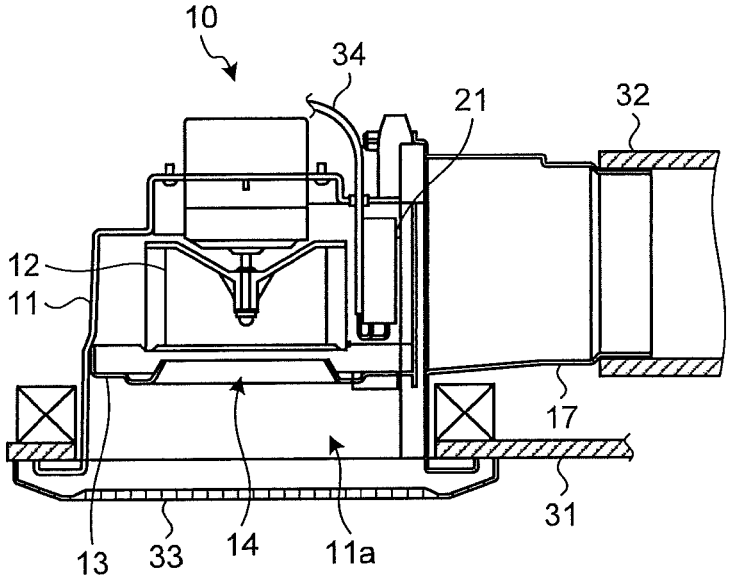
FIG. 3 is a longitudinal sectional view of the ventilator according to the embodiment.
Figure 4:
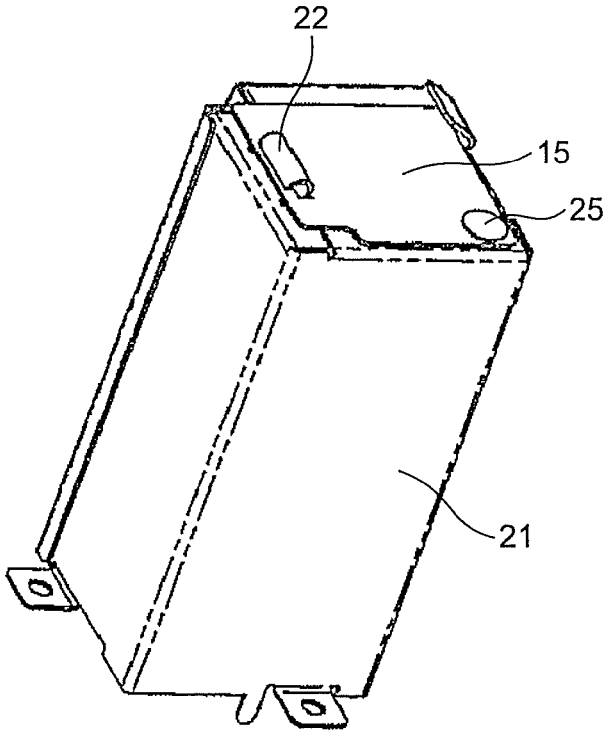
FIG. 4 is a perspective view illustrating a sheet-metal case that covers a terminal block of the ventilator according to the embodiment.
Figure 5:
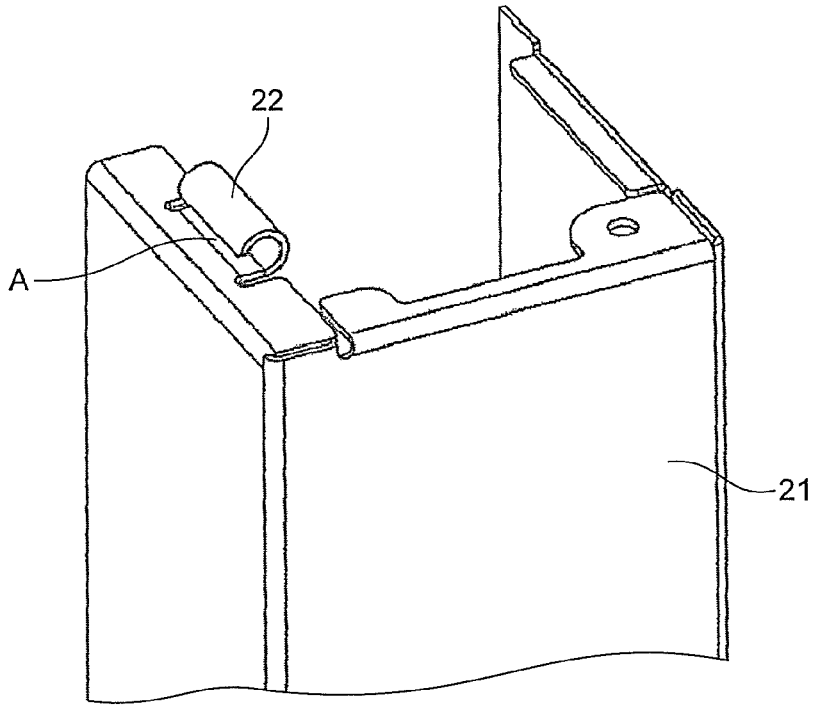
FIG. 5 is a perspective view illustrating a sheet-metal terminal block cover mounting portion of the sheet-metal case of the ventilator according to the embodiment.
Figure 6:
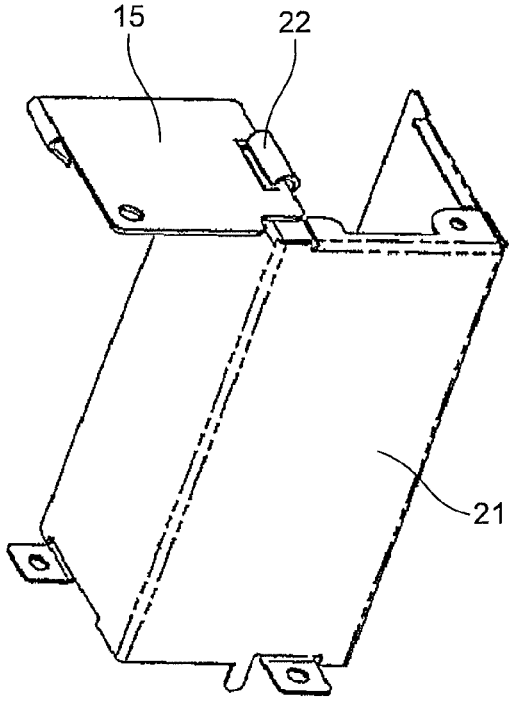
FIG. 6 is a perspective view illustrating a method of mounting a sheet-metal terminal block cover of the ventilator according to the embodiment.
Figure 7:
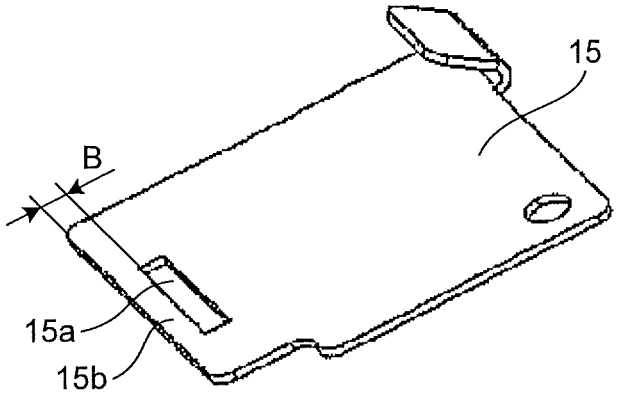
FIG. 7 is a perspective view illustrating the sheet-metal terminal block cover of the ventilator according to the embodiment.
Figure 8:
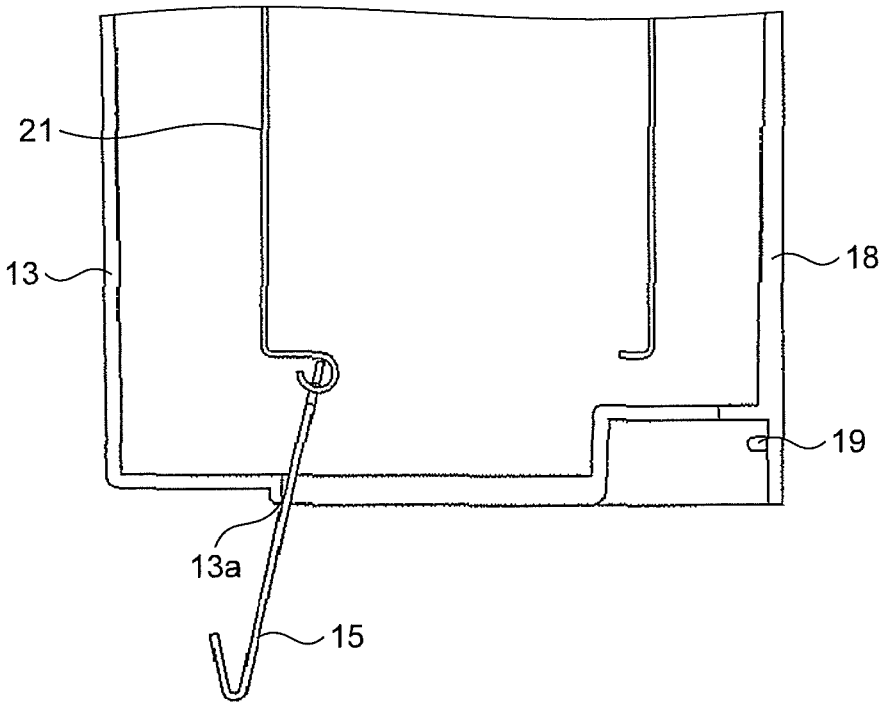
FIG. 8 is a sectional view illustrating a state in which the sheet-metal terminal block cover of the ventilator according to the embodiment is opened.
Figure 9:
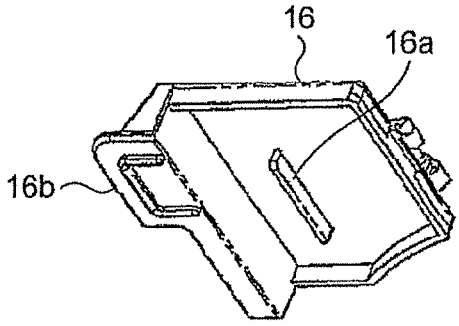
FIG. 9 is a perspective view illustrating a rear surface of the resin terminal block cover of the ventilator according to the embodiment.
Figure 10:
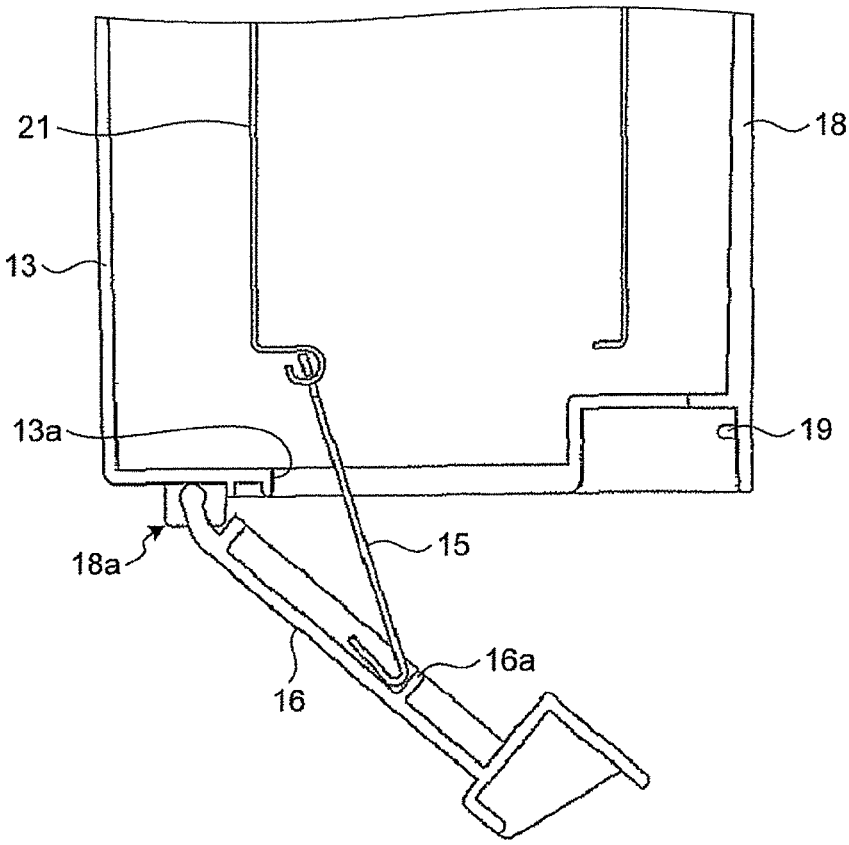
FIG. 10 is a sectional view illustrating a state in which the resin terminal block cover and the sheet-metal terminal block cover of the ventilator according to the embodiment interfere with each other.

FIG. 1 is a bottom view illustrating a state in which a resin terminal block cover of a ventilator according to an embodiment of the present invention is closed. FIG. 2 is a bottom view illustrating a state in which the resin terminal block cover of the ventilator according to the embodiment is removed. FIG. 3 is a longitudinal cross-sectional view of the ventilator according to the embodiment. FIG. 4 is a perspective view illustrating a sheet-metal case that covers a terminal block of the ventilator according to the embodiment. FIG. 5 is a perspective view illustrating a sheet-metal terminal block cover mounting portion of the sheet-metal case of the ventilator according to the embodiment. FIG. 6 is a perspective view illustrating a method of mounting a sheet-metal terminal block cover of the ventilator according to the embodiment. FIG. 7 is a perspective view illustrating the sheet-metal terminal block cover of the ventilator according to the embodiment. FIG. 8 is a cross-sectional view illustrating a state in which the sheet-metal terminal block cover of the ventilator according to the embodiment is opened. FIG. 9 is a perspective view illustrating a rear surface of the resin terminal block cover of the ventilator according to the embodiment. FIG. 10 is a cross-sectional view illustrating a state in which the resin terminal block cover and the sheet-metal terminal block cover of the ventilator according to the embodiment interfere with each other.

As shown in FIGS. 1 to 3, a ventilator 10 according to the embodiment is provided on the rear side of a ceiling 31 of a building, sucks indoor air, and exhausts the indoor air to the outside through a duct 32. The ventilator 10 includes a sheet-metal box-like body casing 11, a fan 12 that is assembled in the body casing 11, a duct connection tube 17 that is mounted in an exhaust port (not shown in the drawings) formed on one side of the body casing 11 in a detachable manner, and a decorative panel 33 that is mounted along the ceiling 31 so as to cover an opening 11*a* formed at a lower portion of the body casing 11.

The fan 12 sucks indoor air through the opening 11*a* of the lower portion of the body casing 11 and exhausts the indoor air to the outside via a resin fan casing 13, the exhaust port, the duct connection tube 17, and the duct 32. The resin fan casing 13 of the fan 12 is provided in the opening 11*a* of the lower portion of the body casing 11 and closes the opening 11*a* of the body casing 11 other than a bell-mouthed suction port 14. In an internal corner of the body casing 11 and outside an air passage of the fan 12 of the fan casing 13, a terminal block (not shown in the drawings) that includes a quick connection terminal to connect the fan 12 and external power supply electric wire 34 to each other is disposed.

In the internal corner of the body casing 11 and outside the fan casing 13 (outside the air passage), a protection frame 18 is formed in such a manner that it covers (stores) the terminal block, has an outer circumferential portion contacting an inner surface of the body casing 11, and has an open upper portion. The protection frame 18 includes a resin terminal block cover 16 that can be opened and closed by a hinge 18*a* (refer to FIGS. 1 and 10), which water-tightly seals a protection frame opening 13*a* of the lower portion of the protection frame 18.

An open end of the lower portion of the protection frame 18 and an outer circumferential portion of the resin terminal block cover 16 are sealed by a fitting relationship of recessed/projecting portions. If a claw 16*b* (refer to FIGS. 9 and 10) of the resin terminal block cover 16 is locked to a locking projection 19 (refer to FIGS. 2, 8, and 10) provided in the protection frame 18, the resin terminal block cover 16 is closed and locked. The terminal block is isolated from the opening 11*a* (suction side of the fan 12) of the lower portion of the body casing 11 by the protection frame 18 and the resin terminal block cover 16, and is protected from moisture even under high humidity atmosphere.

In order to prevent the resin fan casing 13 and the protection frame 18 from being worn when the terminal block is overheated, as shown in FIGS. 4 to 10, a sheet-metal case 21 that stores (encases) the terminal block and a sheet-metal terminal block cover 15 that can open and close a lower opening of the sheet-metal case 21 are provided in the protection frame 18 and the resin terminal block cover 16. If the sheet-metal terminal block cover 15 that can open and close the lower opening of the sheet-metal case 21 is provided, a connecting operation of the external power supply electric wire 34 (refer to FIG. 3) to the terminal block can be performed from the side of the opening 11*a* of the body casing 11.

As shown in FIGS. 4 to 7, a semicylindrical cover hooking portion 22 is provided in the sheet-metal case 21 to cause the sheet-metal terminal block cover 15 to be opened and closed. A slit 15*a* of the sheet-metal terminal block cover 15 is hooked on the semicylindrical cover hooking portion 22 of the sheet-metal case 21 so as to be used as a cover of the sheet-metal case 21.

If the opening width A (refer to FIG. 5) of the cover hooking portion 22 of the sheet-metal case 21 is set to be equal to or more than the thickness of the sheet-metal terminal block cover 15 and to be less than the width B (refer to FIG. 7) of a hooking portion 15*b*, and an angle of when the sheet-metal terminal block cover 15 is closed is set to 0°, the hooking portion 15*b* is not released from the opening of the cover hooking portion 22, until the opening angle of the sheet-metal terminal block cover 15 becomes 145°.

In order to prevent the sheet-metal terminal block cover 15 from being released from the cover hooking portion 22 or falling down even though the sheet-metal terminal block cover 15 is opened by 180°, it is necessary to bend the cover hooking portion 22 after the slit 15*a* of the sheet-metal terminal block cover 15 is hooked on the cover hooking portion 22, so that the opening width A of the cover hooking portion 22 becomes equal to or less than the thickness of the sheet-metal terminal block cover 15 in a state in which the sheet-metal terminal block cover 15 shown in FIG. 4 is closed.

After the sheet-metal case 21 is fitted on the body casing 11, the resin fan casing 13 is fitted in the body casing 11. As shown in FIG. 8, the protection frame opening 13*a* is formed such that the sheet-metal terminal block cover 15 is brought into contact with the protection frame opening 13*a*, when the sheet-metal terminal block cover 15 is opened by 90° or more, for example, 145°.

In this way, the opening width A of the cover hooking portion 22 of the sheet-metal case 21 does not need to be decreased by post processing, and a structure in which the sheet-metal terminal block cover 15 does not fall down can be formed at a low cost. The fan casing 13 is fitted at the time of assembling in a manufacturing factory of the ventilator 10, and is not removed at the time of installing, electrical work or of activating the ventilator 10. Therefore, the sheet-metal terminal block cover 15 does not fall.

If a screw 25 (refer to FIGS. 2 and 4) is removed, the sheet-metal terminal block cover 15 is opened by its own weight. After wire connection in the electrical work is completed, if the resin terminal block cover 16 of the fan casing 13 is closed without closing the sheet-metal terminal block cover 15 using the screw 25, the resin terminal block cover 16 can be closed, even though the sheet-metal terminal block cover 15 has not been closed.

For the purpose of preventing misfastening of the screw 25 of the sheet-metal terminal block cover 15, as shown in FIGS. 9 and 10, if such a configuration is formed as that a rib 16*a* is provided on the rear side of the resin terminal block cover 16 and the sheet-metal terminal block cover 15 is brought into contact with the rib 16*a* to inhibit the resin terminal block cover 16 from being closed, when the resin terminal block cover 16 is tried to be closed in a state where the screw 25 of the sheet-metal terminal block cover 15 is misfastened and the sheet-metal terminal block cover 15 is opened, then the misfastening of the screw 25 of the sheet-metal terminal block cover 15 can be prevented.

As described above, the ventilator 10 according to the above-mentioned embodiment can prevent the resin fan casing 13 and the protection frame 18 from being worn, even in case in which the terminal block is overheated.

INDUSTRIAL APPLICABILITY

As such, the ventilator according to the present invention is effectively used as a ventilator that is provided in a bathroom or a kitchen.

The invention claimed is:

1. A ventilator, comprising:

a body casing that has an opening formed in a lower portion and an exhaust port formed on one side;

a fan that is provided in the body casing, sucks indoor air from the opening, and exhausts the indoor air from the exhaust port;

a resin fan casing that has a suction port, is provided in the opening, closes the opening other than the suction port, and forms an air passage of the fan;

a protection frame that is formed outside the air passage of the fan casing to cover a terminal block provided in an internal corner of the body casing outside the air passage of the fan casing;

a resin terminal block cover that watertightly seals a protection frame opening of a lower portion of the protection frame and can be opened and closed;

a sheet-metal case that is provided in the protection frame and stores the terminal block;

a sheet-metal terminal block cover that opens and closes a lower opening of the sheet-metal case; and a rib provided on the rear side of the resin terminal block cover, such that the sheet-metal terminal block cover bumps against the rib and closing of the resin terminal block cover is disabled, when the resin terminal block cover is closed in a state in which the sheet-metal terminal block cover is opened.

2. The ventilator of claim 1, wherein a semicylindrical cover hooking portion is provided in the sheet-metal case and a slit of the sheet-metal terminal block cover is hooked on the cover hooking portion.

3. The ventilator of claim 2, wherein, when the sheet-metal terminal block cover is opened by 90° or more, the sheet-metal terminal block cover is brought into contact with the protection frame opening, such that the slit of the sheet-metal terminal block cover is not released from an opening of the semicylindrical cover hooking portion.

* * * * *